US011392156B2

(12) United States Patent
Elwan et al.

(10) Patent No.: US 11,392,156 B2
(45) Date of Patent: Jul. 19, 2022

(54) VOLTAGE GENERATOR WITH MULTIPLE VOLTAGE VS. TEMPERATURE SLOPE DOMAINS

(71) Applicant: SHENZHEN GOODIX TECHNOLOGY CO., LTD., Shenzhen (CN)

(72) Inventors: Hassan Osama Elwan, San Diego, CA (US); Esmail Babakrpur Nalousi, San Diego, CA (US)

(73) Assignee: SHENZHEN GOODIX TECHNOLOGY CO., LTD., Shenzhen (CN)

( * ) Notice: Subject to any disclaimer, the term of this patent is extended or adjusted under 35 U.S.C. 154(b) by 147 days.

(21) Appl. No.: 16/726,773

(22) Filed: Dec. 24, 2019

(65) Prior Publication Data

US 2021/0191444 A1 Jun. 24, 2021

(51) Int. Cl.
*G05F 3/24* (2006.01)

(52) U.S. Cl.
CPC ..... *G05F 3/245* (2013.01); *G05F 3/247* (2013.01)

(58) Field of Classification Search
CPC ..... G05F 3/22–30; G05F 3/245–247; G05F 1/468; G05F 1/463; G05F 1/56; G05F 1/567
USPC ..... 323/273, 281
See application file for complete search history.

(56) References Cited

U.S. PATENT DOCUMENTS 5,087,831 A * 2/1992 Ten Eyck ..... G05F 1/462 327/513
5,160,882 A * 11/1992 Ten Eyck ..... G05F 1/462 323/313
5,281,906 A * 1/1994 Thelen, Jr. ..... G05F 3/245 323/313
5,963,105 A * 10/1999 Nguyen ..... H03L 7/00 331/1 R
5,963,439 A * 10/1999 Wuidart ..... H02M 3/1584 363/46
6,501,256 B1 12/2002 Jaussi et al.
(Continued)

FOREIGN PATENT DOCUMENTS

CN 1747065 A 3/2006
CN 1828472 A 9/2006
(Continued)

OTHER PUBLICATIONS

European Patent Office, Extended European Search Report issued in Application No. 20967260.2, dated Jun. 3, 2022, Germany, 8 pages.

*Primary Examiner* — Thienvu V Tran
*Assistant Examiner* — Nusrat Quddus
(74) *Attorney, Agent, or Firm* — Kilpatrick Townsend & Stockton LLP

(57) ABSTRACT

An electronic circuit is disclosed. The electronic circuit includes a reference voltage generator, which includes a first candidate circuit configured to generate a first candidate reference voltage, a second candidate circuit configured to generate a second candidate reference voltage, and a selector circuit configured to select one of the first and second candidate reference voltages. The reference voltage generator also includes a third circuit configured to generate a power supply voltage based on the selected candidate reference voltage.

20 Claims, 8 Drawing Sheets

(56) References Cited

U.S. PATENT DOCUMENTS 7,307,468 B1 * 12/2007 Vasudevan ..... G05F 3/30 327/539
8,531,235 B1 * 9/2013 Zonte ..... G05F 3/30 327/512
8,564,275 B2 * 10/2013 Seok ..... G05F 3/242 323/313
8,638,084 B1 * 1/2014 Abugharbieh ..... G05F 3/30 438/11
8,710,812 B1 * 4/2014 Edwards ..... G05F 1/56 323/281
8,710,898 B1 * 4/2014 Chiang ..... H03F 1/301 327/362
8,947,067 B1 * 2/2015 Zarei ..... G05F 3/30 323/316
10,852,758 B2 * 12/2020 Mahadik ..... H03F 3/45071
10,990,221 B2 * 4/2021 Krah ..... G06F 3/04166
2001/0006342 A1 * 7/2001 Kusumoto ..... H02M 3/155 323/355
2004/0155700 A1 * 8/2004 Gower ..... G05F 3/30 327/543
2004/0245977 A1 * 12/2004 Tran ..... G05F 3/30 323/315
2005/0046466 A1 3/2005 Koelling
2006/0158165 A1 * 7/2006 Inn ..... H02M 3/1588 323/280
2006/0181335 A1 * 8/2006 Hsu ..... G05F 3/30 327/539
2007/0040543 A1 2/2007 Yeo et al.
2009/0085651 A1 * 4/2009 Liu ..... G05F 3/30 327/539
2010/0001711 A1 * 1/2010 Marinca ..... G05F 3/30 323/313
2011/0057718 A1 * 3/2011 Snoeij ..... H03F 3/45766 327/512
2012/0176186 A1 * 7/2012 Chen ..... G05F 3/30 327/539
2012/0293154 A1 11/2012 Samir et al.
2014/0003164 A1 * 1/2014 Fifield ..... G11C 8/08 365/189.09
2014/0070788 A1 * 3/2014 Pottbaecker ..... G05F 3/30 323/313
2014/0145701 A1 * 5/2014 Temkine ..... G05F 3/30 323/314
2014/0191742 A1 * 7/2014 Kung ..... H02M 3/156 323/282
2015/0168969 A1 * 6/2015 Shor ..... G05F 3/30 713/340
2015/0286236 A1 * 10/2015 Dornseifer ..... G05F 3/16 323/313
2016/0070280 A1 * 3/2016 Day ..... G05F 1/625 323/275
2016/0179124 A1 * 6/2016 Madan ..... G05F 3/262 323/313
2017/0011806 A1 * 1/2017 Gangasani ..... G11C 16/30
2017/0115677 A1 * 4/2017 Caffee ..... G05F 1/468
2017/0257113 A1 * 9/2017 Singh ..... G01K 7/34
2018/0017986 A1 * 1/2018 Lahiri ..... G05F 3/30
2018/0095486 A1 * 4/2018 Wan ..... G05F 1/465
2018/0101190 A1 * 4/2018 Lee ..... G05F 3/30
2019/0121383 A1 * 4/2019 Englekirk ..... G05F 3/242
2019/0170592 A1 * 6/2019 Jeong ..... G01K 7/01
2019/0324491 A1 * 10/2019 Zou ..... H04R 3/00
2020/0233445 A1 * 7/2020 Mouret ..... G05F 1/462
2020/0286575 A1 * 9/2020 Chang ..... G11C 29/38
2021/0157348 A1 * 5/2021 Murakami ..... G05F 1/468

FOREIGN PATENT DOCUMENTS

CN 103729009 A 4/2014
CN 104777869 A 7/2015
CN 105739587 A 7/2016

* cited by examiner

VOLTAGE GENERATOR WITH MULTIPLE VOLTAGE VS. TEMPERATURE SLOPE DOMAINS

FIELD OF THE INVENTION

The present application generally pertains to voltage generators, and more particularly to voltage generators which generate voltages across a wide range of temperatures.

BACKGROUND OF THE INVENTION

Bandgap voltage generators may be used to generate reference voltages which have a desired dependence on temperature. For example, bandgap voltage generators may generate reference voltages which have approximately zero voltage depends over a particular temperature range of interest.

BRIEF SUMMARY OF THE INVENTION

One inventive aspect is an electronic circuit. The electronic circuit includes a reference voltage generator, which includes a first candidate circuit configured to generate a first candidate reference voltage, a second candidate circuit configured to generate a second candidate reference voltage, and a selector circuit configured to select one of the first and second candidate reference voltages. The electronic circuit also includes a third circuit configured to generate a power supply voltage based on the selected candidate reference voltage.

In some embodiments, the first candidate circuit is configured to cause the first candidate reference voltage to change by an first amount in response to changing a temperature from a first temperature value to a second temperature value, the second candidate circuit is configured to cause the second candidate reference voltage to change by an second amount in response to changing the temperature from the first temperature value to the second temperature value, and the first amount is greater than the second amount.

In some embodiments, the second amount is substantially zero.

In some embodiments, at temperatures which are greater than a crossover temperature, the first candidate reference voltage is greater than the second candidate reference voltage, at temperatures which are less than the crossover temperature, the first candidate reference voltage is less than the second candidate reference voltage, and, at the crossover temperature, the first candidate reference voltage is equal to the second candidate reference voltage.

In some embodiments, the selector circuit is configured to select a maximum of the first candidate reference voltage and the second candidate reference voltage.

In some embodiments, the third circuit is configured to receive the selected candidate reference voltage.

In some embodiments, the third circuit is configured to receive a level shifted version of the selected first or second candidate voltage.

In some embodiments, the third circuit includes a voltage regulator.

In some embodiments, the voltage regulator is configured to generate the power supply voltage for a digital circuit and an analog circuit.

In some embodiments, at temperatures which are greater than a crossover temperature, the first candidate reference voltage is greater than the second candidate reference voltage, at temperatures which are less than the crossover temperature, the first candidate reference voltage is less than the second candidate reference voltage, and, at the crossover temperature, the first candidate reference voltage is equal to the second candidate reference voltage.

In some embodiments, the electronic circuit is specified to function at a particular temperature value less than the crossover temperature, the first candidate circuit is configured to generate the first candidate reference voltage with a particular reference voltage value at the particular temperature, the voltage regulator is configured to generate the power supply voltage with a particular power supply voltage value in response to receiving a voltage of the particular reference voltage value, and the analog circuit is configured to not function with the particular power supply voltage value at the particular temperature.

Another inventive aspect is a method of operating an electronic circuit. The electronic circuit includes a reference voltage generator. The reference voltage generator includes first and second candidate circuits, a selector circuit, and a third circuit. The method includes, with the first candidate circuit, generating a first candidate reference voltage, with the second candidate circuit, generating a second candidate reference voltage, with the selector circuit, selecting one of the first and second candidate reference voltages, and with the third circuit, receiving a power supply voltage based on the selected candidate reference voltage.

In some embodiments, the method also includes, with the first candidate circuit, causing the first candidate reference voltage to change by an first amount in response to changing a temperature from a first temperature value to a second temperature value, and, with the second candidate circuit, causing the second candidate reference voltage to change by an second amount in response to changing the temperature from the first temperature value to the second temperature value, where the first amount is greater than the second amount.

In some embodiments, at temperatures which are greater than a crossover temperature, the first candidate reference voltage is greater than the second candidate reference voltage, at temperatures which are less than the crossover temperature, the first candidate reference voltage is less than the second candidate reference voltage, and, at the crossover temperature, the first candidate reference voltage is equal to the second candidate reference voltage.

In some embodiments, the method also includes, with the selector circuit selecting a maximum of the first candidate reference voltage and the second candidate reference voltage.

In some embodiments, the method also includes, with the third circuit, receiving the selected candidate reference voltage.

In some embodiments, the method also includes, with the third circuit, receiving a level shifted version of the selected first or second candidate voltage.

In some embodiments, the method also includes, with a voltage regulator generating the power supply voltage for a digital circuit and an analog circuit.

In some embodiments, at temperatures which are greater than a crossover temperature, the first candidate reference voltage is greater than the second candidate reference voltage, at temperatures which are less than the crossover temperature, the first candidate reference voltage is less than the second candidate reference voltage, and, at the crossover temperature, the first candidate reference voltage is equal to the second candidate reference voltage.

In some embodiments, the electronic circuit is specified to function at a particular temperature value less than the crossover temperature, and the method further includes, with the first candidate circuit is configured to generate the first candidate reference voltage with a particular reference voltage value at the particular temperature, where the voltage regulator is configured to generate the power supply voltage with a particular power supply voltage value in response to receiving a voltage of the particular reference voltage value, and where the analog circuit is configured to not function with the particular power supply voltage value at the particular temperature.

DETAILED DESCRIPTION OF THE INVENTION

Particular embodiments of the invention are illustrated herein in conjunction with the drawings.

Various details are set forth herein as they relate to certain embodiments. However, the invention can also be implemented in ways which are different from those described herein. Modifications can be made to the discussed embodiments by those skilled in the art without departing from the invention. Therefore, the invention is not limited to particular embodiments disclosed herein.

Figure 1:
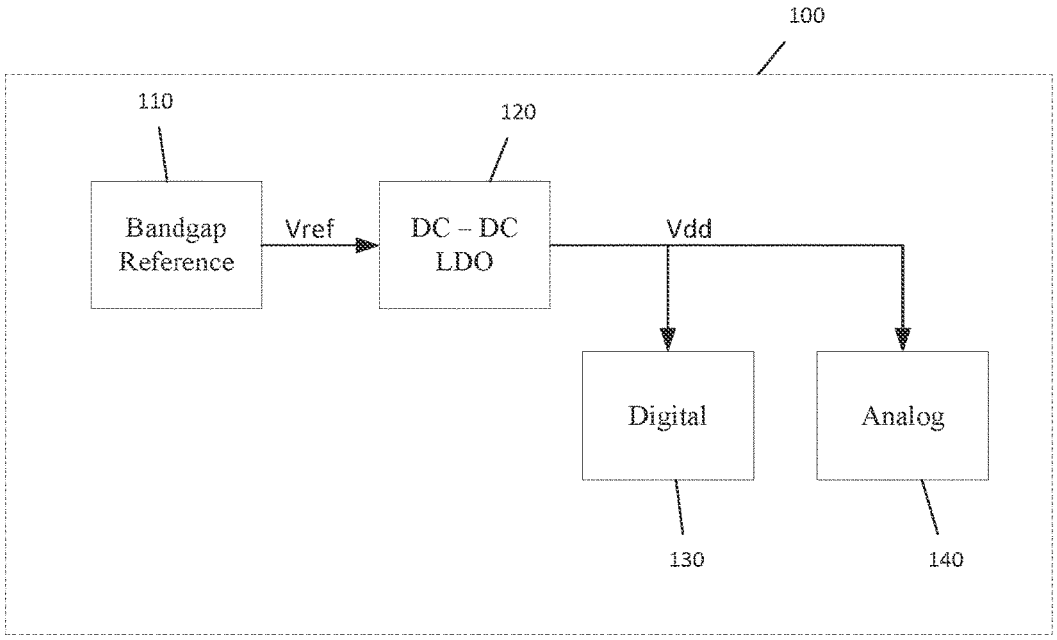
FIG. 1 is a schematic diagram illustrating a power distribution system for an electronic system.

FIG. 1 is a schematic diagram illustrating a power distribution system for an electronic system 100. System 100 includes bandgap reference voltage generator 110, power supply voltage generator 120, digital circuitry 130, an analog circuitry 140.

Bandgap voltage generator 110 may be any bandgap voltage generator. For example any bandgap voltage generator known to those of skill in the art may be used. Typically bandgap voltage generators generate reference voltages which vary with temperature according to the temperature variation of one or more bipolar junction transistors and one or more resistors. In alternative embodiments, other reference voltage generators may be used.

Power supply voltage generator 120 receives a reference voltage from bandgap voltage generator 110, and generates a power supply voltage based on the received reference voltage. For example, power supply voltage generator 120 may receive a 1 V reference voltage from reference voltage generator 110, and generate a 3 V supply voltage.

In some embodiments, power supply voltage generator 120 generates a supply voltage which is a substantially constant factor times the received reference voltage. For example, the supply voltage may be three times the received reference voltage. For example, if power supply voltage generator 120 receives a 1.1 V reference voltage from reference voltage generator 110, power supply voltage generator 120 may generate a 3.3 V supply voltage.

In this embodiment, power supply voltage generator 120 comprises a DC-DC LDO (low dropout regulator). In alternative embodiments, other voltage regulators or voltage generators may be used.

Digital circuitry 130 receives the supply voltage generated by power supply voltage generator 120, and operates according to the functionality of the digital circuitry therein, as powered by current received from the power supply voltage generator 120.

Analog circuitry 140 receives the supply voltage generated by power supply voltage generator 120, and operates according to the functionality of the analog circuitry therein, as powered by current received from the power supply voltage generator 120. Analog circuitry 140 receives the supply voltage generated by power supply voltage generator 120, and operates according to the functionality of the analog circuitry, as powered by current received from the power supply voltage generator 120.

Bandgap reference voltage generator 110 may be advantageously configured to generate a reference voltage which varies with temperature. The requirements for the reference voltage generated by bandgap reference voltage generator 110 include that the generated reference voltage causes power supply voltage generator 120 generate a supply voltage which allows for digital circuitry 130 and analog circuitry 140 to operate within their respective specified functionality limits.

As understood by those of skill in the art, the functionality of each of digital circuitry 130 and analog circuitry 140 is affected by temperature. For example, each of digital circuitry 130 analog circuitry 140 may operate faster at colder temperatures. Therefore, bandgap reference voltage generator 110 may advantageously generate a lower reference voltage at a lower temperature because the resulting lower supply voltage is sufficient for the digital circuitry 130 and analog circuitry 140 to operate within their respective specified functionality limits.

As understood by those of skill in the art, analog circuitry 140 has power supply voltage requirements which are independent of speed. For example, analog circuitry 140 will have insufficient voltage headroom if the power supply voltage is too low, regardless of the analog circuitry 140 being fast enough at the low power supply voltage.

Figure 2A:
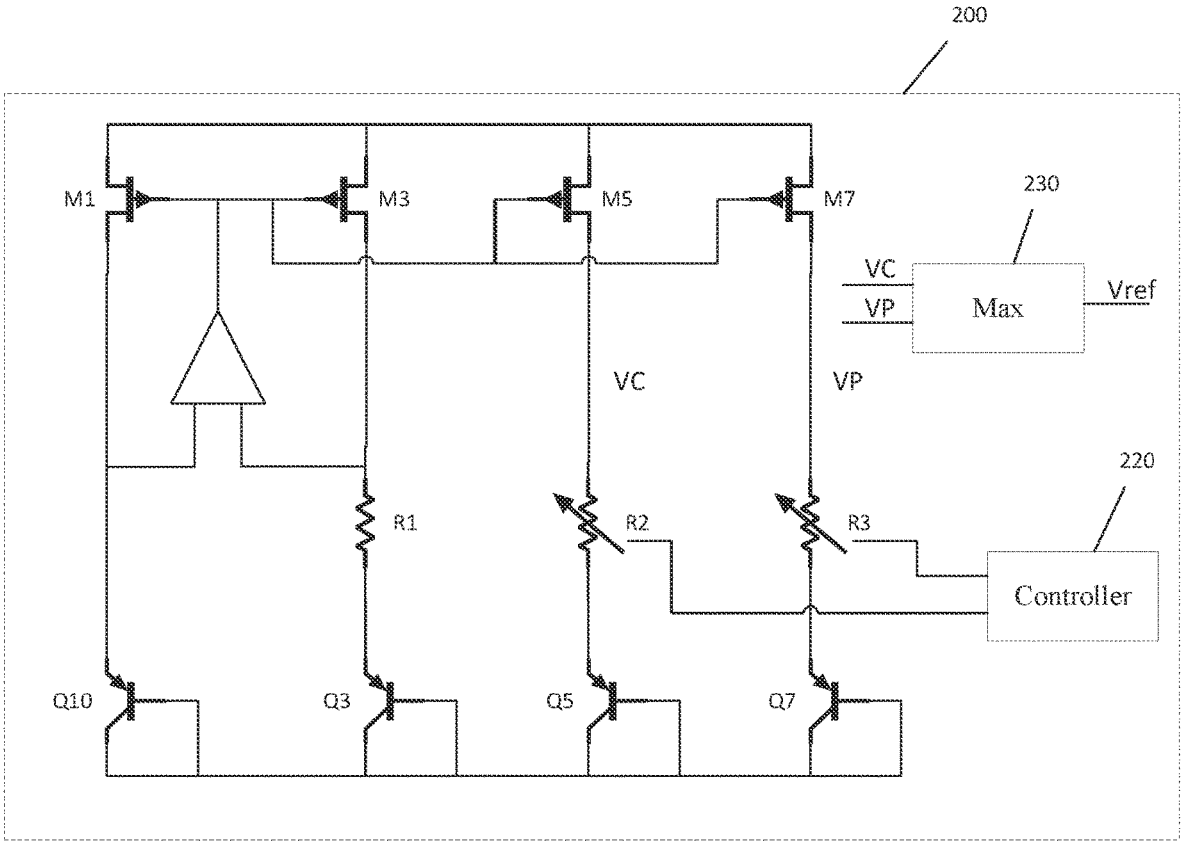
FIG. 2A is a schematic diagram of a voltage generator according to an embodiment.

FIG. 2A is a schematic diagram of a bandgap voltage reference generator 200 according to an embodiment. Bandgap voltage reference generator 200 may, for example, be used as bandgap reference voltage generator 110 in system 100 of FIG. 1.

Bandgap voltage reference generator 200 is shown only as an example. As is understood by those of skill in the art, there are many bandgap voltage reference generator topologies which may be used. As understood by those of skill in the art, the principles and aspects discussed herein may be applied with ordinary skill to alternative bandgap voltage reference generator topologies.

The basic functionality of bandgap voltage reference generator 200 is well understood the art, will be omitted for the sake of brevity.

Regarding bandgap voltage reference generator 200, as understood by those of skill in the art, the voltage temperature coefficient of the voltage at node VC may be influenced by the value of variable resistor R2. Similarly, as understood by those of skill in the art, the voltage temperature coefficient of the voltage at node VP may be influenced by the value of variable resistor R3.

In this embodiment, controller 220 is configured to generate control voltages for variable resistors R2 and R3. Based on results of calibration techniques understood by those of skill in the art, controller 220 generates the control voltages.

In the illustrated embodiment, controller 220 generates the control voltages such that the voltage at node VC either increases or decreases with increased temperature. For example, controller 220 may generate a control voltage for variable resistor R2 such that the voltage at node VC decreases with increased temperature.

In the illustrated embodiment, controller 220 generates the control voltages such that the voltage at node VP increases with changing temperature. For example, controller 220 may generate a control voltage for variable resistor R3 such that the voltage at node VP increases across temperature.

Maximum circuit 230 receives the voltages at nodes VC and VP, and generates a voltage at output node Vref which corresponds with the greater of the voltages at nodes VC and VP. For example, the voltage at node VC may be 1.1 V and the voltage at node VP may be 1 V. As a result, maximum circuit 230 may generate a voltage at output node Vref which is equal to 1.1 V. In some embodiments, the voltage generated by maximum circuit 230 at output node Vref may be a level shifted version of the greater of the voltages at nodes VC and VP. A non-limiting example of a maximum circuit is discussed below. Other maximum circuits understood by those of skill in the art may be used.

In this embodiment, at temperatures which are less than a crossover temperature, the voltage at node VP is greater than the voltage at node VC. Similarly, at temperatures which are greater than the crossover temperature, the voltage at node VC is greater than the voltage at node VP. At the crossover temperature, the voltage at node VP is equal to the voltage at node VC. As a result, at temperatures greater than the crossover temperature, the voltage at output node Vref (Vdd in FIG. 2B) is equal to or corresponds with the voltage at node VC, and at temperatures less than the crossover temperature, the voltage at output node Vref is equal to or corresponds with the voltage at node VP.

When used in systems, such as system 100 of FIG. 1, the voltage at power supply node Vdd has a temperature profile corresponding with or substantially identical to the voltage at reference node Vref.

At temperatures less than the crossover temperature, the voltage at output node Vref (Vdd in FIG. 2B) is equal to or corresponds with the voltage at node VP, and decreases in temperature cause the digital circuitry 130 and the analog circuitry 140 to slow down. However, the decreases in temperature also cause voltage at power supply node Vdd to increase. Therefore, the increased voltage at power supply node Vdd may advantageously compensate or at least partially compensate for the circuitry slowness, thereby extending the temperature range over which the digital circuitry 130 and the analog circuitry 140 operate according to their specified functionality.

Similarly, at temperatures less than the crossover temperature, increases in temperature cause the digital circuitry 130 and the analog circuitry 140 to speed up. However, the increases in temperature also cause voltage at power supply node Vdd to decrease. Therefore, the decreased voltage at the power supply node Vdd advantageously allows for the digital circuitry 130 and the analog circuitry 140 to operate according to their specified functionality using less power.

At temperatures greater than the crossover temperature, the voltage at output node Vref (Vdd in FIG. 2B) is equal to or corresponds with the voltage at node VC, and the voltage power supply node advantageously changes according to changes in the voltage at node VC. As a result, temperatures greater than the crossover temperature to not cause the voltage at power supply node Vdd to drop below that which would allow the analog circuitry 140 to operate properly.

Accordingly, the voltage-temperature profile slope–change in voltage/change in temperature (dv/dtemp) for the voltage at the power supply node Vdd for temperatures greater than the crossover temperature is determined by the dv/dtemp of the voltage at node VC, and is different from the dv/dtemp slope at temperatures less than crossover temperature, where the voltage at the power supply node Vdd is determined by the dv/dtemp of the voltage at node VP.

Figure 2B:
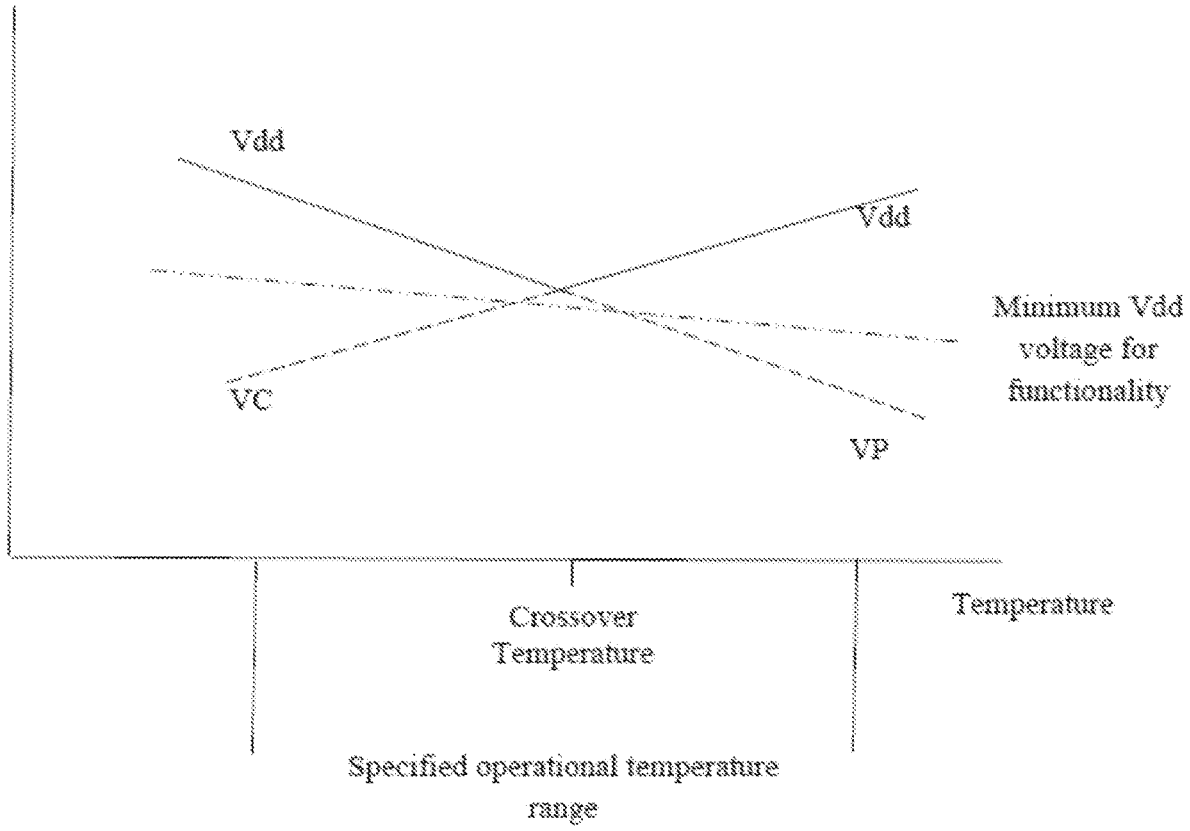
FIG. 2B is a graph schematically illustrating the relationship between the voltage at power supply node Vdd and temperature.

In some embodiments, the Vdd voltage dv/dtemp slope at temperatures greater than the crossover temperature is large enough that, if the Vdd voltage were to continue to drop for decreasing temperature with the same dv/dtemp slope for temperatures less than the crossover temperature, the analog or digital circuitry would fail at a temperature specified as allowing for functional operation. Similarly, in some embodiments, the Vdd voltage dv/dtemp slope at temperatures less than the crossover temperature is large enough that, if the Vdd voltage were to continue to drop for increasing temperature with the same dv/dtemp slope for temperatures greater than the crossover temperature, the analog or digital circuitry would fail at a temperature specified as allowing for functional operation. This is illustrated in FIG. 2B.

Figure 3:
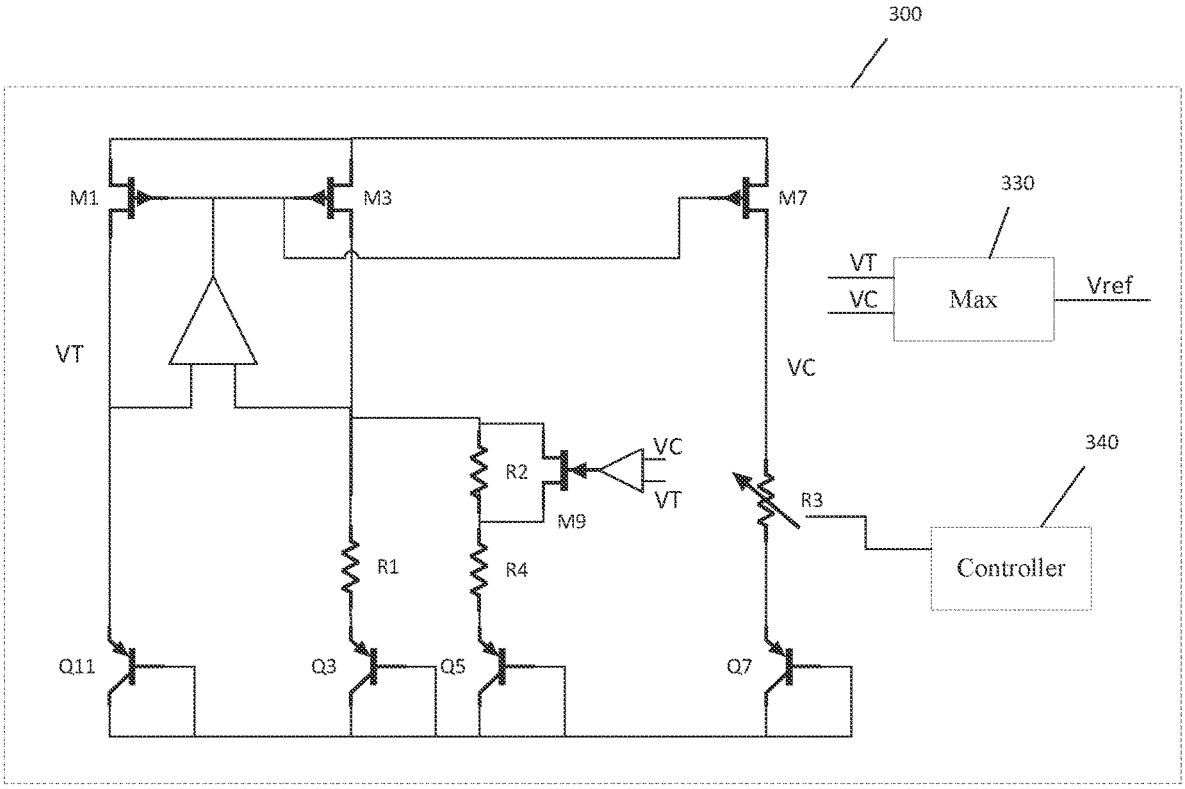
FIG. 3 is a schematic diagram of a voltage generator according to another embodiment.

FIG. 3 is a schematic diagram of a bandgap voltage reference generator 300 according to another embodiment. Bandgap voltage reference generator 300 may, for example, be used as bandgap reference voltage generator 110 in system 100 of FIG. 1.

Bandgap voltage reference generator 300 is shown only as an example. As is understood by those of skill in the art, there are many bandgap voltage reference generator topologies which may be used. As understood by those of skill in the art, the principles and aspects discussed herein may be applied with ordinary skill to alternative bandgap voltage reference generator topologies.

The basic functionality of bandgap voltage reference generator 300 is well understood the art, will be omitted for the sake of brevity.

Regarding bandgap voltage reference generator 300, as understood by those of skill in the art, the temperature coefficient of the voltage at node VC may be influenced by the value of variable resistor R3.

In this embodiment, controller 320 is configured to generate control voltage for variable resistor R3. Based on results of calibration techniques understood by those of skill in the art, controller 320 generates the control voltage. In the illustrated embodiment, controller 320 generates the control voltage such that the voltage at node VC decreases with increasing temperature.

In addition, the reference generator 300 may be designed such that the voltage at node VT increases with increasing temperature.

Maximum circuit 330 receives the voltages at nodes VC and VT, and generates a voltage at output node Vref which corresponds with the greater of the voltages at nodes VC and VT. For example, the voltage at node VC may be 1.1 V and the voltage at node VT may be 1 V. As a result, maximum circuit 330 may generate a voltage at output node Vref which is equal to 1.1 V. In some embodiments, the voltage generated by maximum circuit 330 at output node Vref may be a level shifted version of the greater of the voltages at nodes VC and VT. A non-limiting example of a maximum circuit is discussed below. Other maximum circuits understood by those of skill in the art may be used.

In this embodiment, at temperatures which are less than a crossover temperature, the voltage at node VT is greater than the voltage at node VC. Similarly, at temperatures which are greater than the crossover temperature, the voltage VC is greater than the voltage at node VT. At the crossover temperature, the voltage at node VT is equal to the voltage at node VC. As a result, at temperatures greater than the crossover temperature, the voltage at output node Vref (Vdd in FIG. 4) is equal to or corresponds with the voltage at node VC, and at temperatures less than the crossover temperature, the voltage at output node Vref is equal to or corresponds with the voltage at node VT.

When used in systems, such as system 100 of FIG. 1, the voltage at power supply node Vdd has a temperature profile corresponding with or substantially identical to the voltage at reference node Vref.

At temperatures less than the crossover temperature, the voltage at output node Vref (Vdd in FIG. 4) is equal to or corresponds with the voltage at node VT, and decreases in temperature cause the digital circuitry 130 and the analog circuitry 140 to slow down. However, the decreases in temperature also cause voltage at power supply node Vdd to increase. Therefore, the increased voltage at power supply node Vdd may advantageously compensate or at least partially compensate for the circuitry slowness, thereby extending the temperature range over which the digital circuitry 130 and the analog circuitry 140 operate according to their specified functionality.

Similarly, at temperatures less than the crossover temperature, increases in temperature cause the digital circuitry 130 and the analog circuitry 140 to speed up. However, the increases in temperature also cause voltage at power supply node Vdd decrease. Therefore, the decreased voltage at the power supply node Vdd advantageously allows for the digital circuitry 130 and the analog circuitry 140 to operate according to their specified functionality using less power.

At temperatures greater than the crossover temperature, the voltage at output node Vref (Vdd in FIG. 4) is equal to or corresponds with the voltage at node VC, and the voltage power supply node advantageously changes according to changes in the voltage at node VC. As a result, temperatures less than the crossover temperature do not cause the voltage at power supply node Vdd to drop below that which would allow the analog circuitry 140 to operate properly.

Accordingly, the voltage-temperature profile slope–change in voltage/change in temperature (dv/dtemp) for the voltage at the power supply node Vdd for temperatures greater than the crossover temperature is determined by the dv/dtemp of the voltage at node VC, and is different from the dv/dtemp slope at temperatures less than crossover temperature, where the voltage at the power supply node Vdd is determined by the dv/dtemp of the voltage at node VT.

In some embodiments, the Vdd voltage dv/dtemp slope at temperatures greater than the crossover temperature is large enough that, if the Vdd voltage were to continue to drop for decreasing temperature with the same dv/dtemp slope for temperatures less than the crossover temperature, the analog or digital circuitry would fail at a temperature specified as allowing for functional operation. Similarly, in some embodiments, the Vdd voltage dv/dtemp slope at temperatures less than the crossover temperature is large enough that, if the Vdd voltage were to continue to drop for increasing temperature with the same dv/dtemp slope for temperatures greater than the crossover temperature, the analog or digital circuitry would fail at a temperature specified as allowing for functional operation. This is illustrated in FIG. 4.

Figure 4:
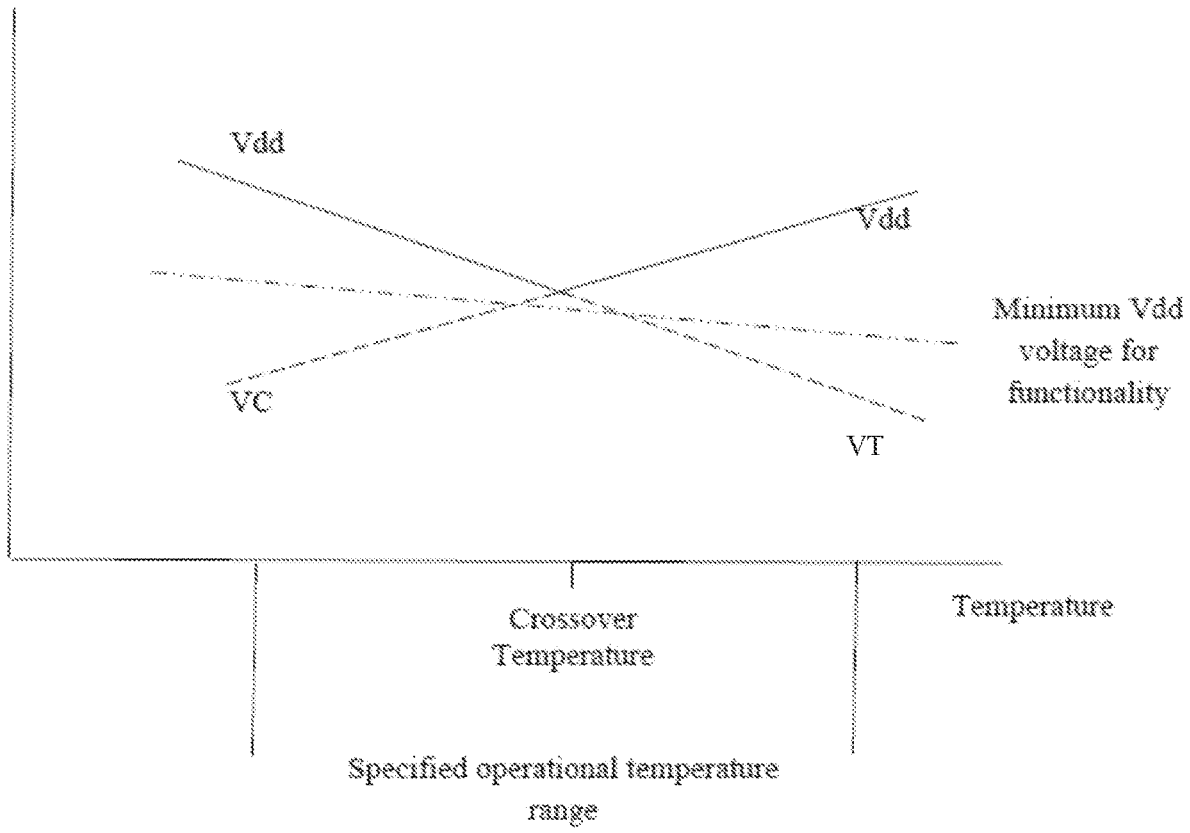
FIG. 4 is a graph schematically illustrating the relationship between the voltage at power supply node Vdd and temperature.

FIG. 4 is a graph schematically illustrating the relationship between the voltage at power supply node Vdd and temperature.

As shown, in this embodiment, for temperatures greater than the crossover temperature, the voltage at power supply node Vdd increases with increased temperature, and decreases with decreased temperature. In contrast, in this embodiment, for temperatures less than the crossover temperature, the voltage power supply node Vdd decreases with increased temperature, and increases with decreased temperature.

FIG. 4 also indicates a minimum Vdd voltage for proper functionality. Were the voltage at power supply node Vdd to decrease below this threshold, system 100 would not function properly. As shown, because the voltage at power supply node Vdd below the crossover temperature does not decrease with decreased temperature at the same rate as above the crossover temperature, the voltage at power supply node Vdd remains above the minimum for functional operation. Similarly, because the voltage at power supply node Vdd above the crossover temperature does not decrease with increased temperature at the same rate as below the crossover temperature, the voltage at power supply node Vdd remains above the minimum for functional operation. Accordingly, the system 100 maintains sufficient voltage at power supply node Vdd for high temperatures, and increases the voltage at power supply node Vdd for low temperatures, when the digital and analog circuitry operate slower.

Figure 5:
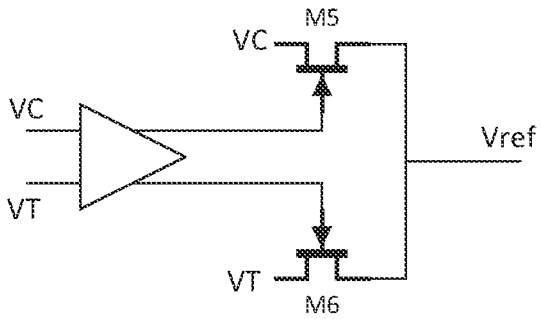
FIG. 5 is a schematic illustration of a maximum circuit.

FIG. 5 is a schematic illustration of a maximum circuit which may be used as a maximum circuit discussed elsewhere herein.

As shown, transistors M5 and M6 form a multiplexer, which electrically connects output node Vref to either of nodes VC and VT. Which of nodes VC and VT are electrically connected to output node Vref is determined by the differential gain circuit, as illustrated, and as understood by those of skill in the art. The differential gain circuit is configured to electrically connect node VC to output node Vref if the voltage at node VC is greater than the voltage node VT, and is configured to electrically connect node VT to output node Vref the voltage at node VT is greater than the voltage at node VC. In some embodiments, the differential gain circuit is hysteretic.

Figure 6:
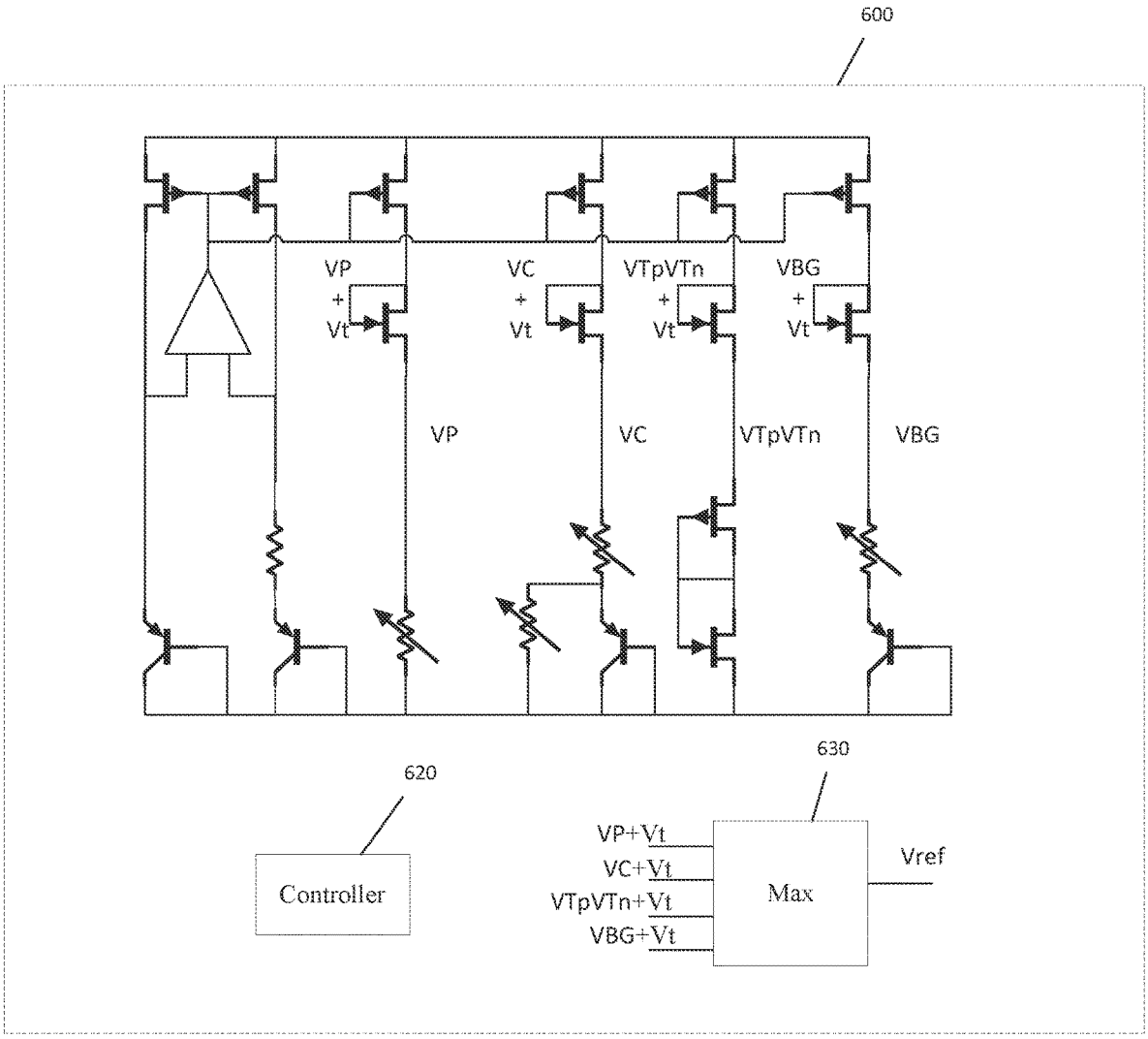
FIG. 6 is a schematic diagram of a voltage generator according to another embodiment.

FIG. 6 is a schematic diagram of a bandgap voltage reference generator 600 according to another embodiment. Bandgap voltage reference generator 600 may, for example, be used as bandgap reference voltage generator 110 in system 100 of FIG. 1.

Bandgap voltage reference generator 600 is shown only as an example. As is understood by those of skill in the art, there are many bandgap voltage reference generator topologies which may be used. As understood by those of skill in the art, the principles and aspects discussed herein may be applied with ordinary skill to alternative bandgap voltage reference generator topologies.

The basic functionality of bandgap voltage reference generator 600 is well understood the art, will be omitted for the sake of brevity.

Regarding bandgap voltage reference generator 600, as understood by those of skill in the art, the voltages and temperature coefficients of the voltages at nodes VP, VC, VTpVTn, and VBG are be influenced by the value of the variable resistors in the circuit. In this embodiment, controller 620 is configured to generate control voltages for the variable resistors. Based on results of calibration techniques understood by those of skill in the art, controller 620 generates the control voltages so as to cause the circuit to generate desired voltages and temperature coefficients of the voltages at nodes VP, VC, VTpVTn, and VBG. In the illustrated embodiment, controller 620 generates the control voltage such that the voltages at nodes VP, VC, VTpVTn, and VBG have the temperature profiles illustrated in FIG. 7. As understood by those of ordinary skill in the art, the voltages at nodes VP, VC, VTpVTn, and VBG may have voltage profiles other than that illustrated in FIG. 7.

Maximum circuit 630 receives the voltages at nodes VP+Vt, VC+Vt, VTpVTn+Vt, and VBG+Vt, and generates a voltage at output node Vref which corresponds with the greatest of voltages at nodes VP, VC, VTpVTn, and VBG. A non-limiting example of a maximum circuit is discussed below. Other maximum circuits understood by those of skill in the art may be used.

When used in systems, such as system 100 of FIG. 1, the voltage at power supply node Vdd has a temperature profile corresponding with or substantially identical to the voltage at reference node Vref.

Accordingly, the voltage-temperature profile slope—change in voltage/change in temperature (dv/dtemp) for the voltage at the power supply node Vdd is temperature dependent, and corresponds with the dv/dtemp temperature profile of a selected one of the voltages at nodes VP, VC, VTpVTn, and VBG of bandgap voltage reference generator 600.

Figure 7:
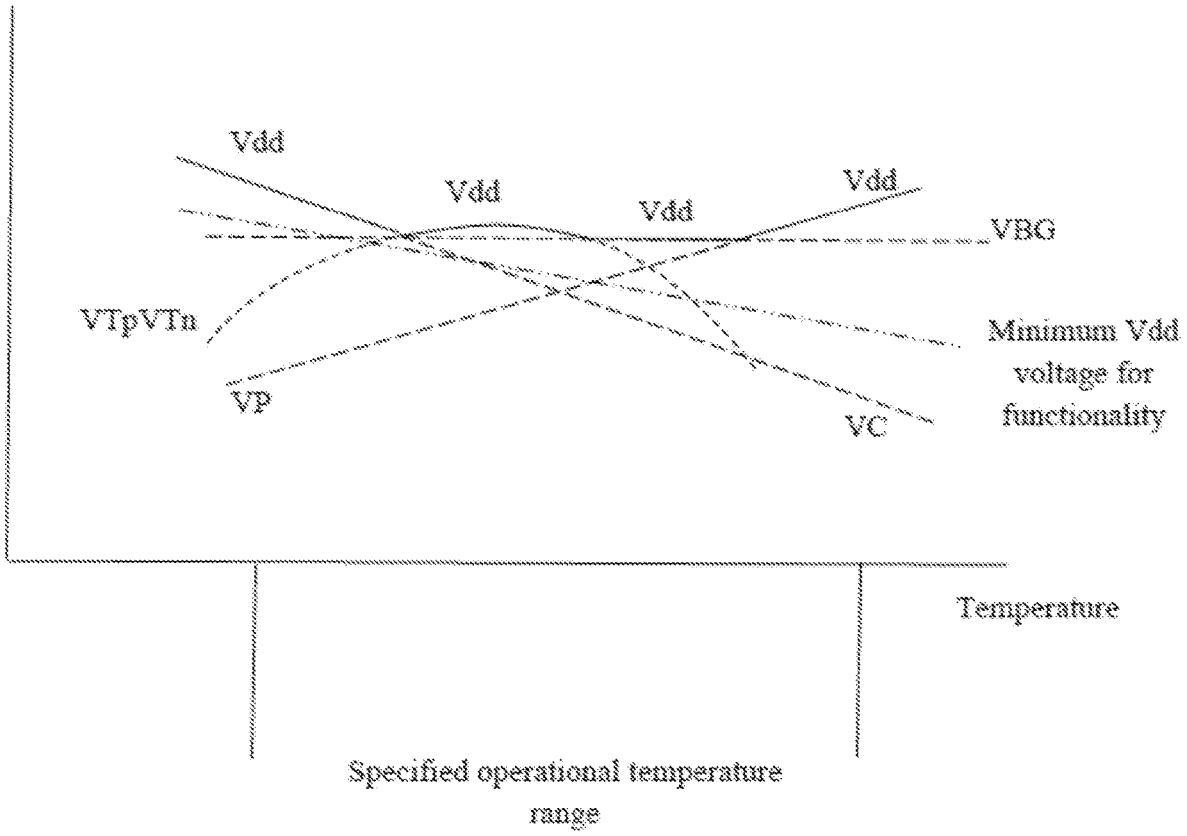
FIG. 7 is a graph schematically illustrating the relationship between the voltage at power supply node Vdd and temperature.

FIG. 7 is a graph schematically illustrating the relationship between the voltage at power supply node Vdd and temperature.

As shown, in this embodiment, the voltage at power supply node Vdd is equal to the greatest of the voltages at nodes VP, VC, VTpVTn, and VBG for all temperatures. Accordingly, the dv/dtemp temperature profile of Vdd is equal to the respective dv/dtemp temperature profile of the greatest of the voltages at nodes VP, VC, VTpVTn, and VBG for all temperatures.

FIG. 7 also indicates a minimum Vdd voltage for proper functionality. Were the voltage at power supply node Vdd to decrease below this threshold, system 100 would not function properly. As shown, because the voltage at power supply node Vdd is equal to the voltages at nodes VP, VC, VTpVTn, and VBG for all, the system 100 maintains sufficient voltage at power supply node Vdd for all temperatures.

Figure 8:
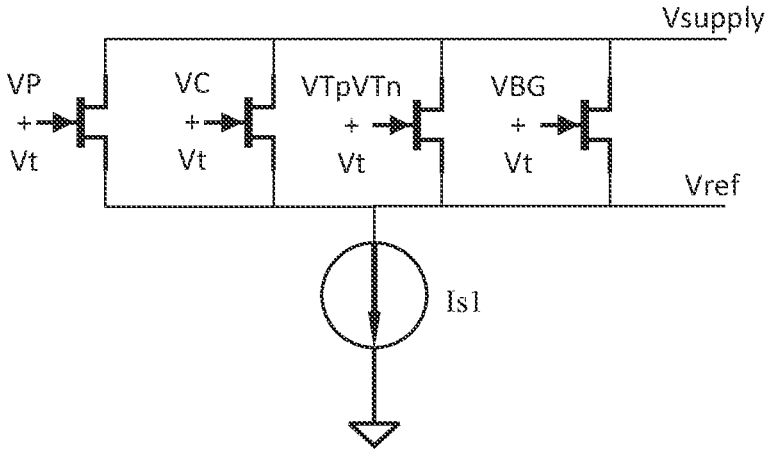
FIG. 8 is a schematic illustration of a maximum circuit.

FIG. 8 is a schematic illustration of a maximum circuit which may be used as a maximum circuit discussed elsewhere herein.

As understood by those of skill in the art, the voltage at output node Vref is equal to the greatest of the voltages at nodes VP+Vt, VC+Vt, VTpVTn+Vt, and VBG+Vt minus Vt. Accordingly, the voltage at the output node Vref is equal to the greatest of the at nodes VP, VC, VTpVTn, and VBG.

Though the present invention is disclosed by way of specific embodiments as described above, those embodiments are not intended to limit the present invention. Based on the methods and the technical aspects disclosed herein, variations and changes may be made to the presented embodiments by those of skill in the art without departing from the spirit and the scope of the present invention.

What is claimed is:

1. An electronic circuit, comprising:

a reference voltage generator, comprising:

a first candidate circuit configured to generate a first candidate reference voltage, a second candidate circuit configured to generate a second candidate reference voltage, and a selector circuit configured to select one of the first and second candidate reference voltages; and a third circuit configured to generate a power supply voltage based on the selected candidate reference voltage, wherein, at temperatures which are greater than a crossover temperature, the first candidate reference voltage is greater than the second candidate reference voltage, wherein, at temperatures which are less than the crossover temperature, the first candidate reference voltage is less than the second candidate reference voltage, and wherein, at the crossover temperature, the first candidate reference voltage is equal to the second candidate reference voltage, wherein the first candidate circuit is configured to cause the first candidate reference voltage to change by an first amount in response to changing a temperature from a first temperature value to a second temperature value, wherein the second candidate circuit is configured to cause the second candidate reference voltage to change by a second amount in response to changing the temperature from the first temperature value to the second temperature value, and wherein the first amount is greater than the second amount.

2. The electronic circuit of claim 1, wherein the second amount is substantially zero.

3. The electronic circuit of claim 1, wherein the selector circuit is configured to select a maximum of the first candidate reference voltage and the second candidate reference voltage.

4. The electronic circuit of claim 1, wherein the third circuit is configured to receive the selected candidate reference voltage.

5. The electronic circuit of claim 1, wherein the third circuit is configured to receive a level shifted version of the selected first or second candidate reference voltage.

6. The electronic circuit of claim 1, wherein the third circuit comprises a voltage regulator, and wherein the voltage regulator is configured to generate the power supply voltage for a digital circuit and an analog circuit.

7. The electronic circuit of claim 6, wherein the electronic circuit is specified to function at a particular temperature value less than the crossover temperature, wherein the first candidate circuit is configured to generate the first candidate reference voltage with a particular reference voltage value at the particular temperature, wherein the voltage regulator is configured to generate the power supply voltage with a particular power supply voltage value in response to receiving a voltage of the particular reference voltage value, and wherein the analog circuit is configured to not function with the particular power supply voltage value at the particular temperature.

8. A method of operating an electronic circuit, the electronic circuit comprising:

a reference voltage generator, comprising:

first and second candidate circuits, and a selector circuit; and a third circuit, the method comprising:

with the first candidate circuit, generating a first candidate reference voltage;

with the second candidate circuit, generating a second candidate reference voltage;

with the selector circuit, selecting one of the first and second candidate reference voltages;

with the third circuit generating a power supply voltage based on the selected candidate reference voltage, wherein, at temperatures which are greater than a crossover temperature, the first candidate reference voltage is greater than the second candidate reference voltage, wherein, at temperatures which are less than the crossover temperature, the first candidate reference voltage is less than the second candidate reference voltage, and wherein, at the crossover temperature, the first candidate reference voltage is equal to the second candidate reference voltage;

with the first candidate circuit, causing the first candidate reference voltage to change by an first amount in response to changing a temperature from a first temperature value to a second temperature value; and with the second candidate circuit causing the second candidate reference voltage to change by an second amount in response to changing the temperature from the first temperature value to the second temperature value, wherein the first amount is greater than the second amount.

9. The method of claim 8, further comprising, with the selector circuit selecting a maximum of the first candidate reference voltage and the second candidate reference voltage.

10. The method of claim 8, further comprising at least one of:

A) with the third circuit, receiving the selected candidate reference voltage; and B) with the third circuit, receiving a level shifted version of the selected first or second candidate reference voltage.

11. The method of claim 8, further comprising, with a voltage regulator generating the power supply voltage for a digital circuit and an analog circuit.

12. The method of claim 11, wherein the electronic circuit is specified to function at a particular temperature value less than the crossover temperature, the method further comprising, with the first candidate circuit is configured to generate the first candidate reference voltage with a particular reference voltage value at the particular temperature, wherein the voltage regulator is configured to generate the power supply voltage with a particular power supply voltage value in response to receiving a voltage of the particular reference voltage value, and wherein the analog circuit is configured to not function with the particular power supply voltage value at the particular temperature.

13. An electronic circuit, comprising:

a reference voltage generator, comprising:

a first candidate circuit configured to generate a first candidate reference voltage, a second candidate circuit configured to generate a second candidate reference voltage, and a selector circuit configured to select one of the first and second candidate reference voltages; and a third circuit configured to generate a power supply voltage based on the selected candidate reference voltage, wherein, at temperatures which are greater than a crossover temperature, the first candidate reference voltage is greater than the second candidate reference voltage, wherein, at temperatures which are less than the crossover temperature, the first candidate reference voltage is less than the second candidate reference voltage, and wherein, at the crossover temperature, the first candidate reference voltage is equal to the second candidate reference voltage, wherein the third circuit is configured to receive a level shifted version of the selected first or second candidate reference voltage.

14. The electronic circuit of claim 13, wherein the third circuit comprises a voltage regulator, and wherein the voltage regulator is configured to generate the power supply voltage for a digital circuit and an analog circuit.

15. An electronic circuit, comprising:

a reference voltage generator, comprising:

a first candidate circuit configured to generate a first candidate reference voltage, a second candidate circuit configured to generate a second candidate reference voltage, and a selector circuit configured to select one of the first and second candidate reference voltages; and a third circuit configured to generate a power supply voltage based on the selected candidate reference voltage, wherein, at temperatures which are greater than a crossover temperature, the first candidate reference voltage is greater than the second candidate reference voltage, wherein, at temperatures which are less than the crossover temperature, the first candidate reference voltage is less than the second candidate reference voltage, and wherein, at the crossover temperature, the first candidate reference voltage is equal to the second candidate reference voltage, wherein the third circuit comprises a voltage regulator, wherein the voltage regulator is configured to generate the power supply voltage for a digital circuit and an analog circuit, wherein the electronic circuit is specified to function at a particular temperature value less than the crossover temperature, wherein the first candidate circuit is configured to generate the first candidate reference voltage with a particular reference voltage value at the particular temperature, wherein the voltage regulator is configured to generate the power supply voltage with a particular power supply voltage value in response to receiving a voltage of the particular reference voltage value, and wherein the analog circuit is configured to not function with the particular power supply voltage value at the particular temperature.

16. The electronic circuit of claim 15, wherein the third circuit is configured to receive at least one of the selected candidate reference voltage and a level shifted version of the selected first or second candidate reference voltage.

17. A method of operating an electronic circuit, the electronic circuit comprising:

a reference voltage generator, comprising:

first and second candidate circuits, and a selector circuit; and a third circuit, the method comprising:

with the first candidate circuit, generating a first candidate reference voltage;

with the second candidate circuit, generating a second candidate reference voltage;

with the selector circuit, selecting one of the first and second candidate reference voltages;

with the third circuit generating a power supply voltage based on the selected candidate reference voltage, wherein, at temperatures which are greater than a crossover temperature, the first candidate reference voltage is greater than the second candidate reference voltage, wherein, at temperatures which are less than the crossover temperature, the first candidate reference voltage is less than the second candidate reference voltage, and wherein, at the crossover temperature, the first candidate reference voltage is equal to the second candidate reference voltage; and with the third circuit, receiving a level shifted version of the selected first or second candidate reference voltage.

18. The method of claim 17, further comprising:

with a voltage regulator generating the power supply voltage for a digital circuit and an analog circuit.

19. A method of operating an electronic circuit, the electronic circuit comprising:

a reference voltage generator, comprising:

first and second candidate circuits, and a selector circuit; and a third circuit, the method comprising:

with the first candidate circuit, generating a first candidate reference voltage;

with the second candidate circuit, generating a second candidate reference voltage;

with the selector circuit, selecting one of the first and second candidate reference voltages;

with the third circuit generating a power supply voltage based on the selected candidate reference voltage, wherein, at temperatures which are greater than a crossover temperature, the first candidate reference voltage is greater than the second candidate reference voltage, wherein, at temperatures which are less than the crossover temperature, the first candidate reference voltage is less than the second candidate reference voltage, and wherein, at the crossover temperature, the first candidate reference voltage is equal to the second candidate reference voltage; and with a voltage regulator generating the power supply voltage for a digital circuit and an analog circuit, wherein the electronic circuit is specified to function at a particular temperature value less than the crossover temperature, the method further comprising, with the first candidate circuit is configured to generate the first candidate reference voltage with a particular reference voltage value at the particular temperature, wherein the voltage regulator is configured to generate the power supply voltage with a particular power supply voltage value in response to receiving a voltage of the particular reference voltage value, and wherein the analog circuit is configured to not function with the particular power supply voltage value at the particular temperature.

20. The method of claim 19, further comprising:

with the third circuit, receiving at least one of the selected candidate reference voltage and a level shifted version of the selected first or second candidate reference voltage.

* * * * *